US009242182B2

(12) United States Patent
Cheng

(10) Patent No.: US 9,242,182 B2
(45) Date of Patent: Jan. 26, 2016

(54) TOY GUN CONSTRUCTION

(71) Applicant: KRISS Industries Asia LTD., Taipei (TW)

(72) Inventor: Li-Te Cheng, Taipei (TW)

(73) Assignee: KRISS Industries Asia LTD., Taipei (TW)

( * ) Notice: Subject to any disclaimer, the term of this patent is extended or adjusted under 35 U.S.C. 154(b) by 0 days.

(21) Appl. No.: 14/485,324

(22) Filed: Sep. 12, 2014

(65) Prior Publication Data

US 2015/0328557 A1 Nov. 19, 2015

(30) Foreign Application Priority Data

May 16, 2014 (TW) ..... 103208674 U

(51) Int. Cl.
*A63H 33/30* (2006.01)
*A63H 5/04* (2006.01)
*F41A 33/06* (2006.01)

(52) U.S. Cl.
CPC . *A63H 5/04* (2013.01); *F41A 33/06* (2013.01)

(58) Field of Classification Search
USPC ..... 446/23, 401, 405, 473; 434/18
See application file for complete search history.

(56) References Cited

U.S. PATENT DOCUMENTS 5,244,431 A * 9/1993 D'Andrade ..... A63H 5/04 42/54
5,569,085 A * 10/1996 Igarashi ..... A63F 9/0291 434/18
5,857,854 A * 1/1999 Kwalwasser ..... F41A 33/06 434/18
7,077,117 B1 * 7/2006 Chu ..... F41B 7/08 124/31
7,100,592 B1 * 9/2006 Yang ..... F41B 7/00 124/67
7,316,565 B2 * 1/2008 Liao ..... F41B 11/89 124/65
7,946,283 B2 * 5/2011 Lee ..... F41B 11/646 124/67
8,123,623 B2 * 2/2012 Kitami ..... A63F 13/06 434/18
8,449,346 B2 * 5/2013 Lee ..... F41B 11/644 124/1

* cited by examiner

*Primary Examiner* — Kurt Fernstrom
(74) *Attorney, Agent, or Firm* — Osha Liang LLP

(57) ABSTRACT

A toy gun construction, comprising a gun housing, a reciprocating assembly and a latch member. The reciprocating assembly has a sliding curve plate and a first elastic unit. The latch member is assembled with a connecting rod, an engaging portion, an extension portion and a second elastic member. The sliding curve plate moves from a dynamic position to a static position, and when the sliding curve plate is at dynamic position the engaging portion is stuck in the indention. By pushing the extension portion the latch member moves toward the sliding curve plate to release the engaging portion from the indention and the sliding curve plate is pulled back to the static position by the first elastic member.

7 Claims, 10 Drawing Sheets

TOY GUN CONSTRUCTION

CROSS REFERENCE

The application claims priority of Taiwan Patent Application NO. 103208674, filed on May 16, 2014, the content thereof is incorporated by reference herein.

BACKGROUND OF THE INVENTION

1. Field of the Invention

The present invention relates to a toy gun and more specifically to a toy gun that provides a trajectory adjustment assembly to adjust projection and incorporates a special effect simulating the operation of a real gun.

2. Description of Related Art

Taiwan patent TW-M3163825 describes a toy gun construction which includes a pull handle, bolt portion, latch unit and a trajectory adjustment assembly. The pull handle can pull the bolt portion to the rear of the barrel, and expose the trajectory adjustment assembly from the shell window for adjusting the projection. A latch unit is formed inside the sliding plate corresponding to the bolt portion. A bolt releasing latch is connected to the extended portion of the latch unit to cause the bolt portion to be released back to the fixing position, thus traveling back and forth in the bolt chamber of the gun body. The toy gun can simulate the motion effects of real guns, so that the simulation of the toy gun is improved.

The problem with the prior art toy gun products, which although they provide a diversity of special effects in operation, is that they require relatively complex and bulky mechanisms to enable the achievement of each of the separate and combined effects. Thus, only a few effects have been incorporated in the prior art constructions. Due to the inherent inefficiencies of production and the accompanying costs of incorporating these special effects into the prior art toy gun products as well as the bulky dimensions, a multiplicity of special effects have not been effectively incorporated into such products. Since the prior art toy gun must accommodate a projection adjustment member and also operate to reciprocate back and forth on the side wall of the gun housing, the construction and mode of operation of the gun is complicated, costly and not easy to repair.

In view of the foregoing, a need exists in the art for an improved toy gun construction. In addition, a need exists for such a toy gun having its own reciprocating mechanism, which is relatively simple and inexpensive to manufacture.

SUMMARY OF THE INVENTION

In general, a toy gun construction is provided having various aspects addressed to overcome the shortcomings in the prior art toy guns discussed above and provides numerous other advantages. An objective of the present invention is to provide a toy gun constructed with a sliding curve plate that reciprocates back and forth on the side wall of the gun housing, and a latch mechanism that controls the sliding curve plate when moving from a static position to a dynamic position.

In order to accomplish the above objective and more, one embodiment of the toy gun construction comprises: a gun housing forming a barrel and a hole made underneath the barrel transversely through both side walls thereof; a reciprocating assembly having a sliding curve plate and a first elastic unit, the sliding curve plate slidably fitting upon a side wall of the barrel and having an indention formed thereon, the first elastic unit having one end connected to the sliding curve plate, and another end connected to the side wall; and a latch member comprising a connecting rod, an engaging portion, an extension portion and a second elastic unit, the connecting rod being positioned through the hole, the engaging portion being formed on the side wall connected to one end of the connecting rod, the extension portion connected to another end of the connecting rod, the second elastic member abutting the gun housing for moving the latch member away from the sliding curve plate.

In an embodiment of the present invention, the gun housing has at least one limiting unit for limiting the sliding curve plate when reciprocating back and forth on the side wall of the gun housing.

In an embodiment of the present invention, the barrel has a projection adjustment member.

In an embodiment of the present invention, the engaging portion is larger than the cross-sectional area of the hole.

In an embodiment of the present invention, the extension portion is larger than the cross-sectional area of the hole.

In an embodiment of the present invention, the latch member has one end abutting against the extension portion, and another end abutting against another side wall of the gun housing.

In an embodiment of the present invention, the connecting rod comprises a groove formed thereon.

In operation the sliding curve plate moves from a dynamic position to a static position. When the sliding curve plate is at the dynamic position the engaging portion is stuck in the indention. Pushing the extension portion moves the latch member toward the sliding curve plate and unlocks the engaging portion from the indention, and the sliding curve plate is pulled back to the static position by the first elastic member.

Therefore, the design of the toy gun construction is non-obvious and sufficiently inventive, and reflects a same general patentability requirement. It is noted that the present invention has the advantages that the invention provides a toy gun construction and makes progress in the fields of manufacturing and consumer products.

BRIEF DESCRIPTION OF THE DRAWINGS

Embodiments of the invention will now be described, by way of example only, with reference to the accompanying drawings in which:

FIG. 3-1 is a perspective view of the reciprocating assembly and the latch member according to the present invention;

FIG. 3-2 is an exploded schematic view of the latch member according to the present invention;

DETAILED DESCRIPTION OF THE INVENTION

The following description is merely exemplary in nature and is in no way intended to limit the present teachings, applications, or uses. Those of skill in the art will recognize that the following description is merely illustrative of the principles of the invention, which may be applied in various ways to provide many different alternative embodiments.

Figure 1:
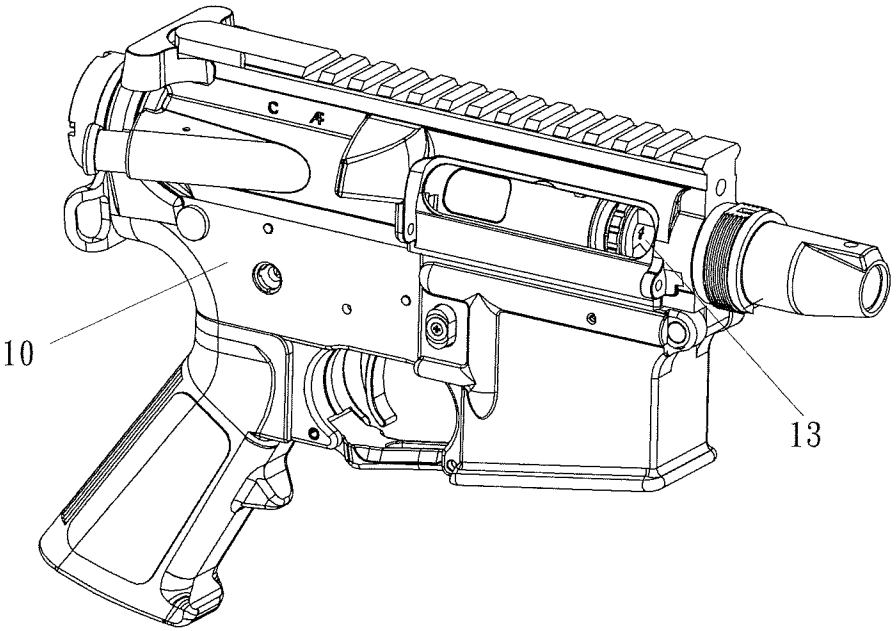
FIG. 1 is a perspective view of the toy gun according to the present invention.
Figure 2:
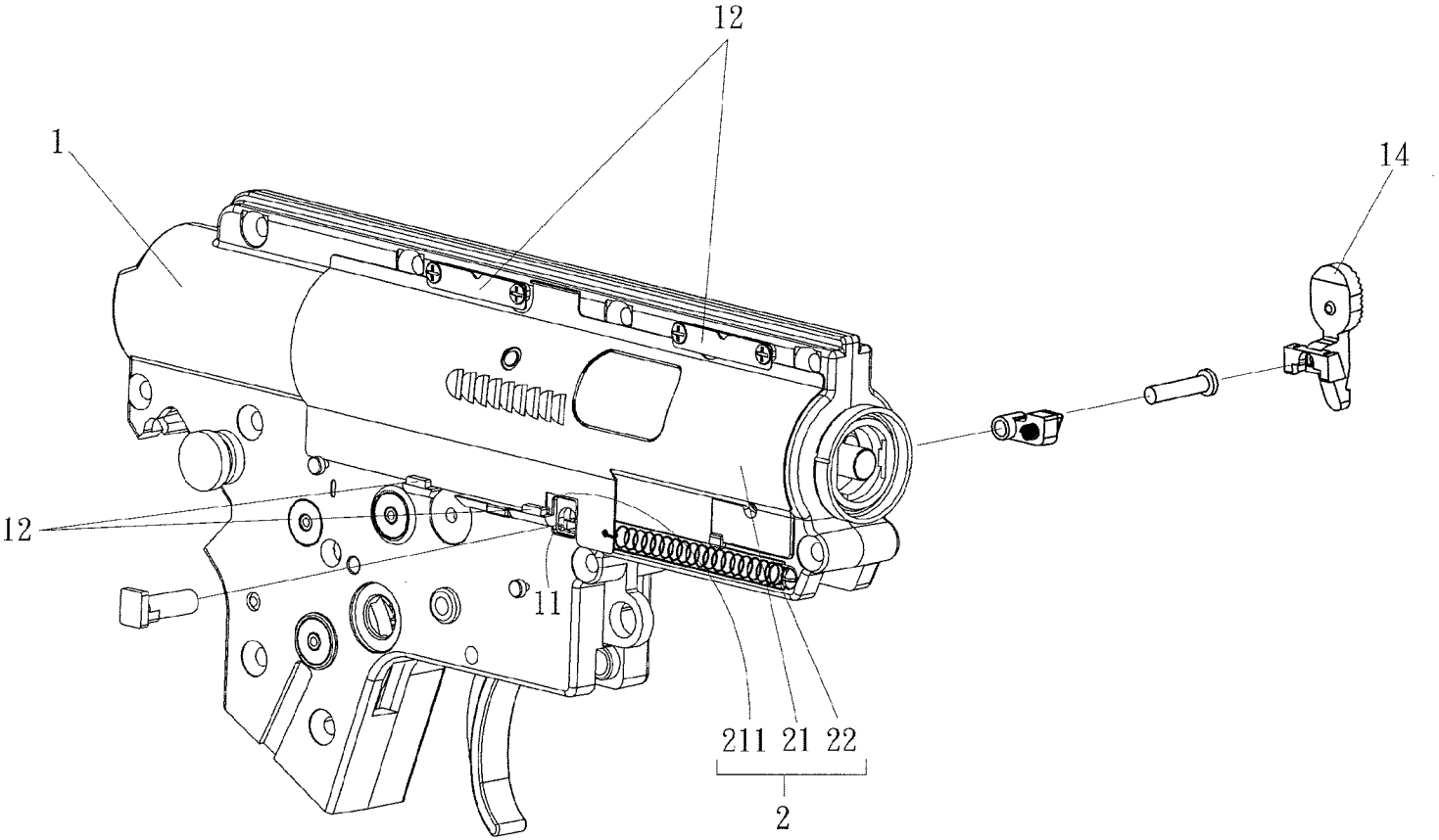
FIG. 2 is a perspective view of the toy gun assembly according to the present invention.
Figures 1, 3:
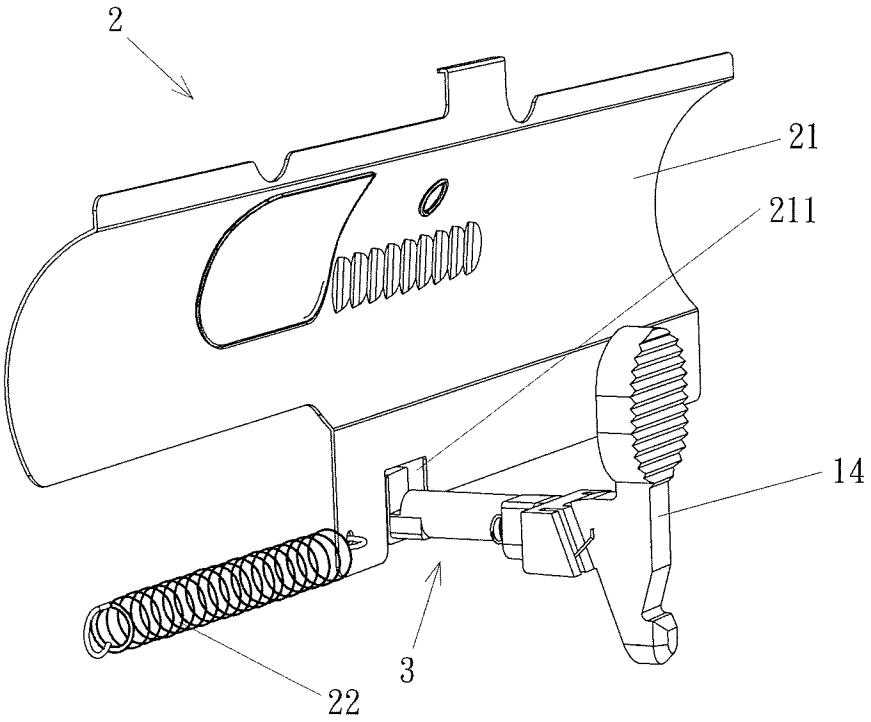
Figures 2, 3:
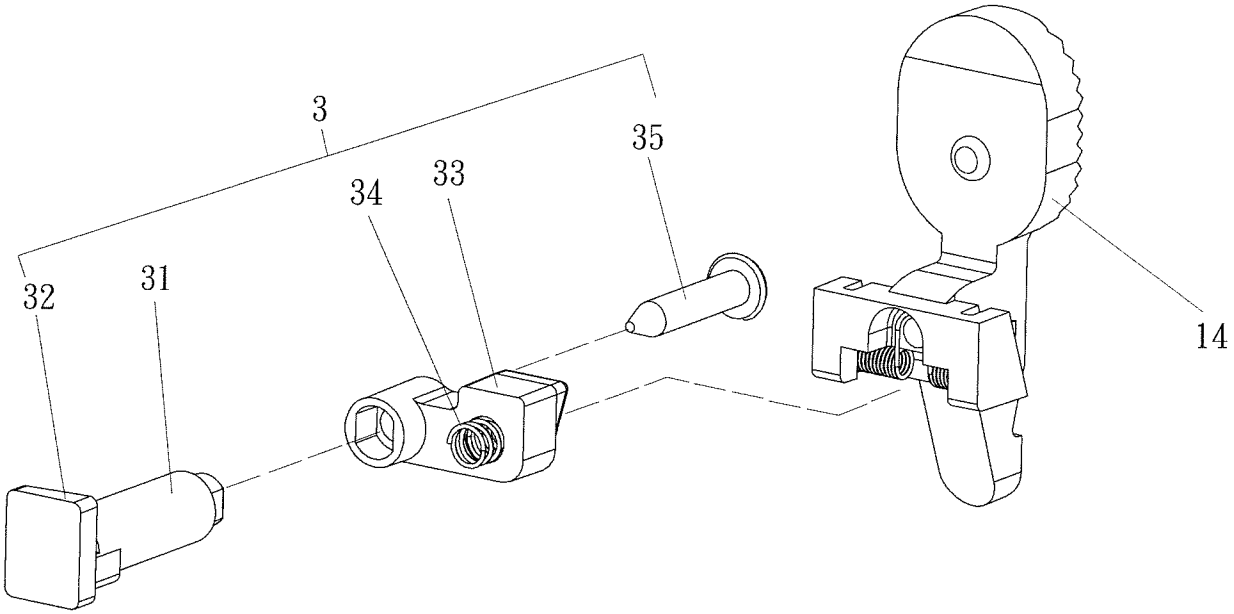

A completely assembled toy gun constructed in accordance with the present invention is shown in FIGS. 1, 2, 3-1 and 3-2. The illustrated toy gun employs a gun housing 1, a reciprocating assembly 2 and a latch member 3, which are constructed on the body 10 of the toy gun.

The gun housing 1 forms a barrel and a hole 11 made underneath the barrel transversely through both side walls, and the barrel has a projection adjustment member 13 contained therein.

The reciprocating assembly 2 comprises a sliding curve plate 21 and a first elastic unit 22, for example, a spring. The sliding curve plate 21 slidably fits upon one side wall of the barrel and has an indention 211 formed thereon. The gun housing 1 has a limiting unit 12 on one side wall of the gun housing 1 for limiting the sliding curve plate 21 when reciprocating back and forth on. The first elastic unit 22 has two ends, one end is connected to the sliding curve plate 21, and the other end is connected to the gun housing 1.

The latch member 3 is assembled with a connecting rod 31, an engaging portion 32, an extension portion 33 and a second elastic member 34. The connecting rod 31 is placed through the hole 11. The engaging portion 32 is formed on the side wall connected to one end of the connecting rod 31, and the extension portion 33 is connected to another end of the connecting rod 31. Both the engaging portion 32 and the extension portion 33 are larger than the cross-sectional area of the hole 11. The second elastic member 34, for example a spring, is between the gun housing 1 and the extension portion 33 with each end cooperating to move the latch member 3 away from the sliding curve plate 21. In one embodiment, the extension portion 33 abuts the release button 14 via a connector 35. The connecting rod 31 and the engaging portion 32 form a component, and the extension portion 33 forms a component with the second elastic unit 34. Both components are joined together with a connector 35, for example a screw.

Figure 4:
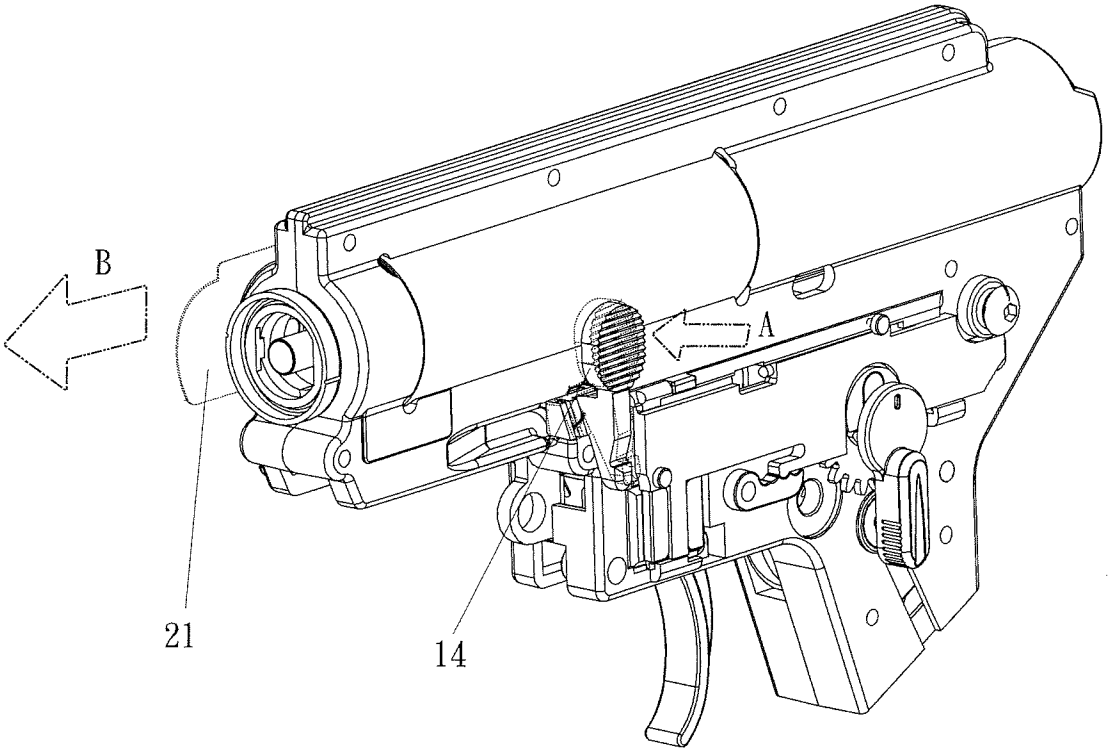
FIG. 4 is a side view of the toy gun construction according to the present invention.
Figure 5:
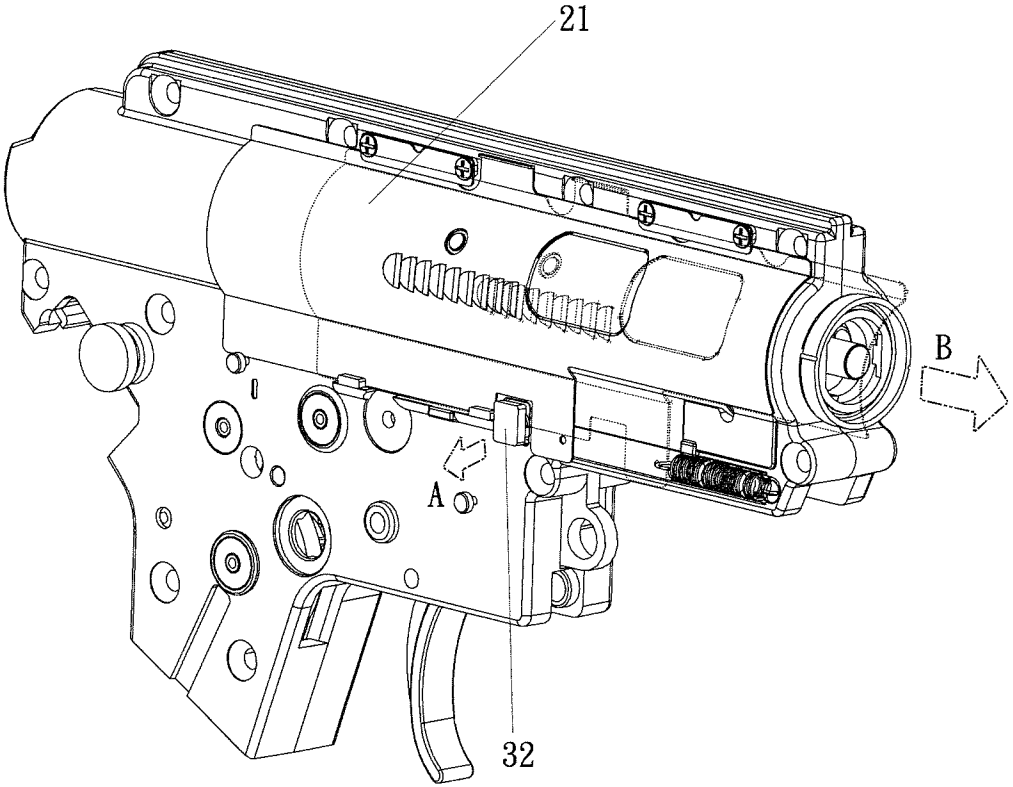
FIG. 5 is a side view of the toy gun construction according to the present invention.

Accordingly, with the construction of the toy gun as described the operation of the device will be readily understood. The mechanism of the sliding curve plate moving from a static position to a dynamic position is described in more detail below. Refer to FIGS. 4 and 5, while continuing to refer to FIGS. 1-3, the sliding curve plate 21 at the dynamic position causes the engaging portion 32 to be stuck in the indention 211. Pushing the extension portion 33 moves the latch member 3 toward the sliding curve plate 21 unlocks the engaging portion 32 from the indention 211 and the sliding curve plate 21 is pulled back to the static position by the first elastic member 22. The sliding curve plate 21 projects out through the elongated horizontal guide slot (limiting unit 12).

Figure 6:
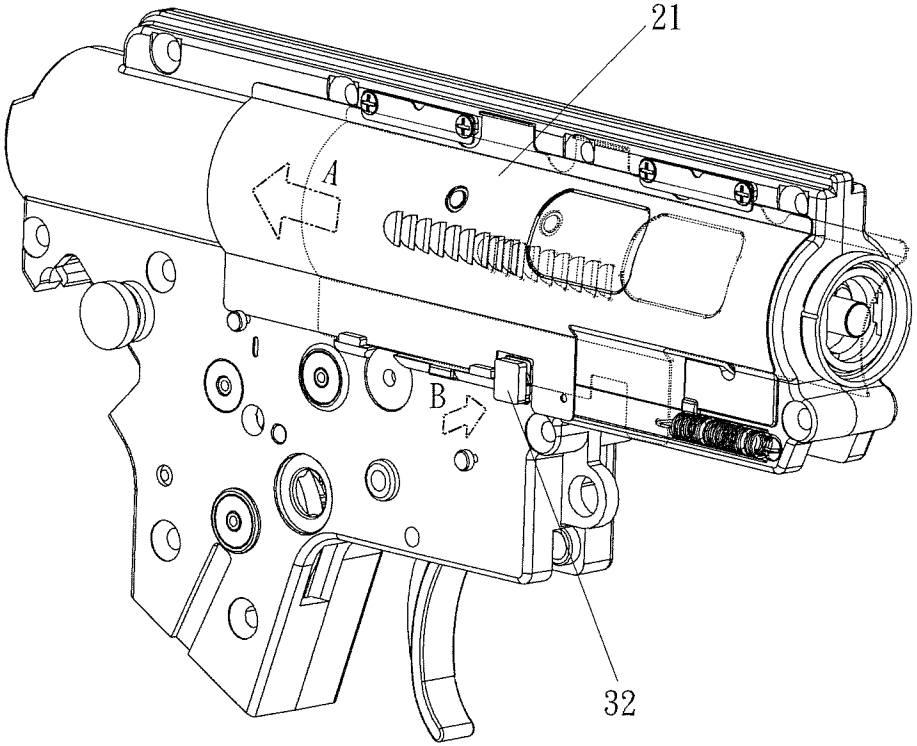
FIG. 6 is a side view showing the sliding curve plate in an extended position according to the present invention.
Figure 7:
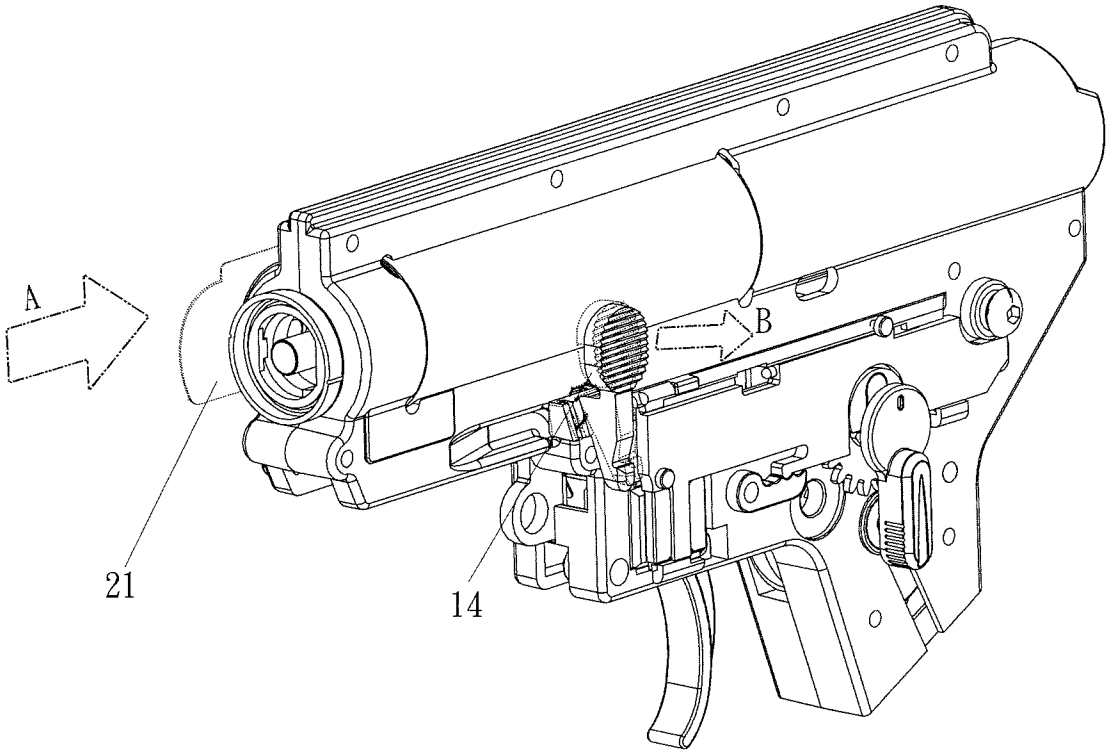
FIG. 7 is a side view showing the sliding curve plate in an extended position according to the present invention.

Referring specifically to FIGS. 6 and 7, it can be seen that the sliding curve plate 21 is at the static position. In the indication of arrow A, the sliding curve plate 21 is in response to a rearward movement of a pull handle (not shown), and the indention 211 of the sliding curve plate 21 is stuck at the engaging portion 32. Specifically, because the second elastic unit 34 in the latch member 3 abuts the extension portion 33 and the side wall of gun housing 1 with two ends respectively, the second elastic unit 34 pushes the latch member 3 away from the sliding curve plate 21 to place the sliding curve plate 21 at the dynamic position by means of indention 211 in engagement with the engaging portion 32. The second elastic unit 34 is compressed by pushing the release button 14 to release the sliding curve plate 21 which is pulled by the first elastic unit 22 back to the static position shown in arrow B direction.

The gun housing 1 has a projection adjustment member 13 inside the barrel. When the sliding curve plate 21 is positioned in the dynamic position, the projection adjustment member 13 is exposed through an open window for the user to adjust the path of a projectile.

Figure 8:
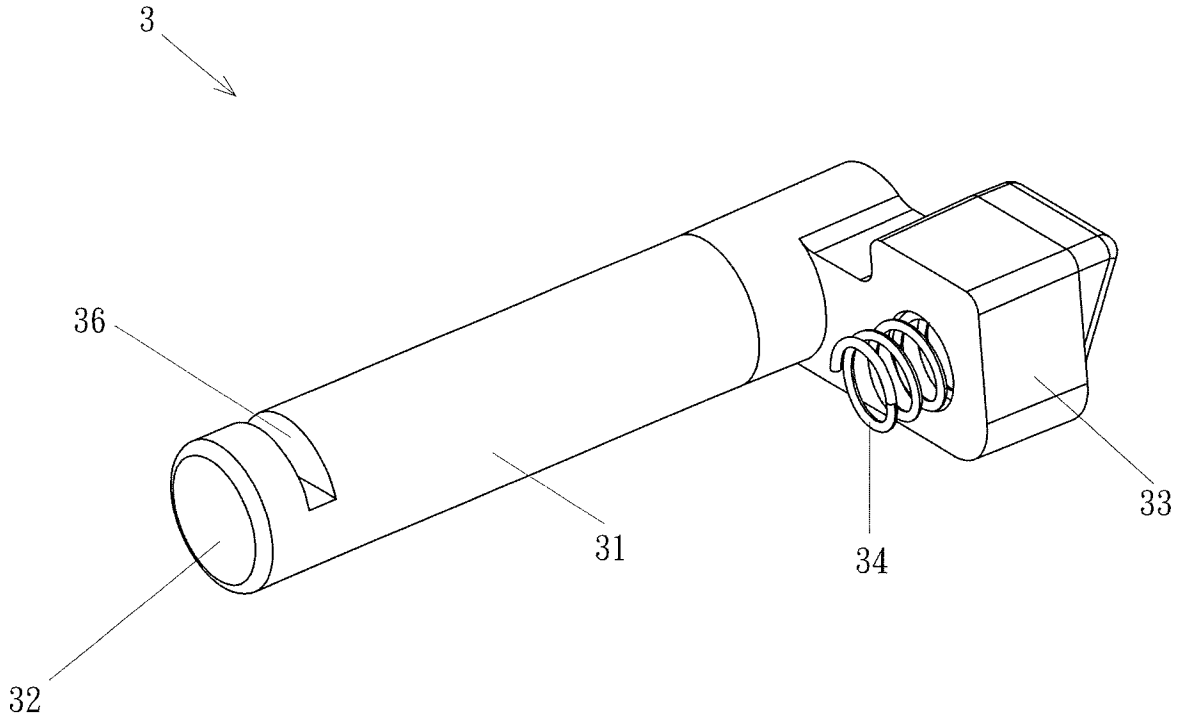
FIG. 8 is a perspective view of the latch member according to the present invention.

Referring specifically to FIG. 8, which illustrates an embodiment of the present invention. In this embodiment the latch member 3 has a different shape but performs the same basic operations as described above, and only differences are described. A groove 36 is formed on the connecting rod 31, which is positioned at the lower edge of the sliding curve plate 21 through the hole 11. As the sliding curve plate 21 is pull back to the dynamic position, the indention 211 becomes stuck at the groove 36 to stop the sliding curve plate 21 in the dynamic position. The engaging portion 32 does not have a bigger area than the hole, but can achieve same function.

Figure 9:
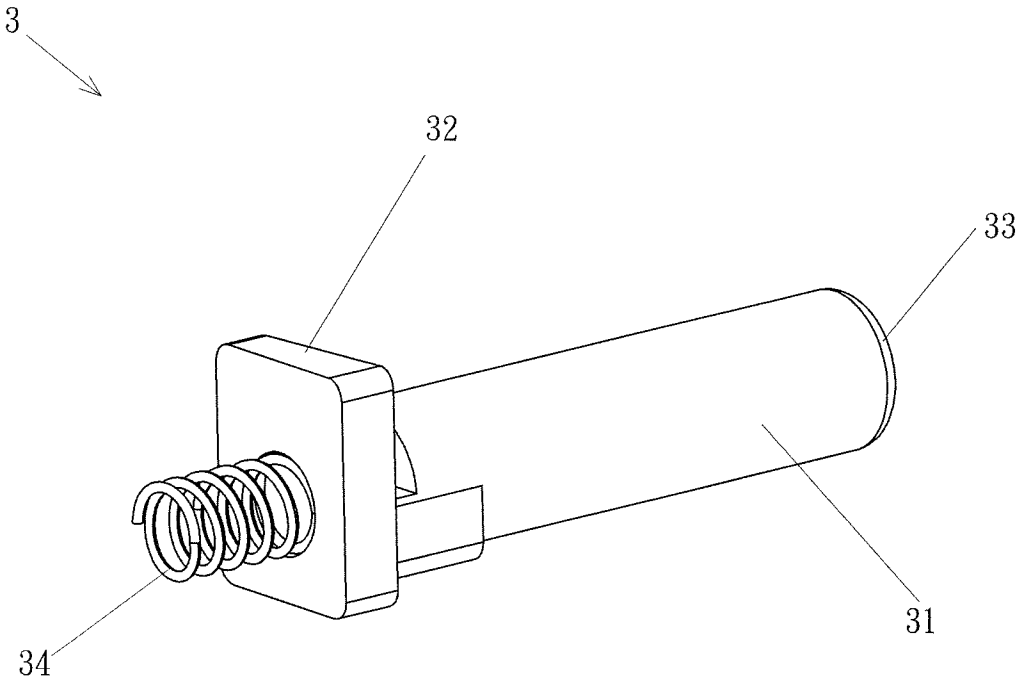
FIG. 9 is a perspective view of the latch number according to the present invention.

Referring specifically to FIGS. 9 and 1, another construction according to an embodiment of the present invention is illustrated. The construction of the second elastic unit 34 abuts the engaging portion 32 at one end and the other end abuts the body 10 and makes the latch member 3 move away from the sliding curve plate 21.

From the foregoing specification with figures, it is obvious that the invention have provided a toy gun construction which is inexpensive from a manufacturing standpoint and yet provides a construction that has a relatively low cost and one that is easy to repair or operate.

The invention is non-obvious and sufficiently inventive, and reflects a same general patentability requirement. It is noted that the present invention has the advantages that the invention provides toy gun construction and makes practical progress in the fields of manufacturing and consumer products.

While the invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A toy gun construction, comprising:

a gun housing, forming a barrel and a hole made underneath the barrel transversely through both side walls thereof;

a reciprocating assembly, having a sliding curve plate and a first elastic unit, the sliding curve plate slidably fitting upon a side wall of the barrel and having an indention formed thereon, the first elastic unit having one end connected to the sliding curve plate, and another end connected to the side wall; and a latch member, comprising a connecting rod, an engaging portion, an extension portion and a second elastic unit, the connecting rod being positioned through the hole, the engaging portion being formed on the side wall connected to one end of the connecting rod, the extension portion connected to another end of the connecting rod, the second elastic member abutting the gun housing for moving the latch member away from the sliding curve plate;

wherein the sliding curve plate moves from a dynamic position to a static position, and when the sliding curve plate is at the dynamic position the engaging portion is stuck in the indention, and when the extension portion is pushed the latch member moves toward the sliding curve plate to unlock the engaging portion and the indention, and the sliding curve plate is pulled back to the static position by the first elastic member.

2. The toy gun construction as claimed in claim 1, wherein the gun housing has at least one limiting unit on the side wall of the gun housing for limiting the sliding curve plate when reciprocating back and forth.

3. The toy gun construction as claimed in claim 1, wherein the barrel further comprises a projection adjustment member.

4. The toy gun construction as claimed in claim 1, wherein the engaging portion is larger than the cross-sectional area of the hole.

5. The toy gun construction as claimed in claim 1, wherein the extension portion is larger than the cross-sectional area of the hole.

6. The toy gun construction as claimed in claim 1, wherein the latch member has one end abutting the extension portion, and another end abutting another side wall of the gun housing.

7. The toy gun construction as claimed in claim 1, wherein a groove is formed on the connecting rod.

* * * * *